United States Patent [19]

Audelo

[11] 4,321,124

[45] Mar. 23, 1982

[54] LOOSE PARTS PLATING APPARATUS

[75] Inventor: Alexander P. Audelo, Westlake Village, Calif.

[73] Assignee: Select Technology Corporation, Chatsworth, Calif.

[21] Appl. No.: 230,756

[22] Filed: Feb. 2, 1981

[51] Int. Cl.[3] ..... C25D 17/28

[52] U.S. Cl. ..... 204/202; 204/224 R

[58] Field of Search ..... 204/206, 198, 201, 224 R, 204/15, 202

[56] References Cited

U.S. PATENT DOCUMENTS

| | | | |
|---|---|---|---|
| 3,649,507 | 3/1972 | Welter | 204/202 |
| 3,904,489 | 9/1975 | Johnson | 204/15 |
| 3,951,772 | 4/1976 | Bick et al. | 204/224 R X |
| 4,042,480 | 8/1977 | Noz | 204/224 R |
| 4,045,321 | 8/1977 | Bernardi | 204/224 R X |

*Primary Examiner*—T. M. Tufariello

*Attorney, Agent, or Firm*—Jack C. Munro

[57] ABSTRACT

A loose parts plating apparatus wherein the loose parts are assembled in a spaced-apart manner through holes mounted within a continuous belt. The continuous belt is conducted over a plating bath reservoir. A portion of each loose part that is desired to be plated is conducted through a plating solution located within a reservoir.

24 Claims, 12 Drawing Figures

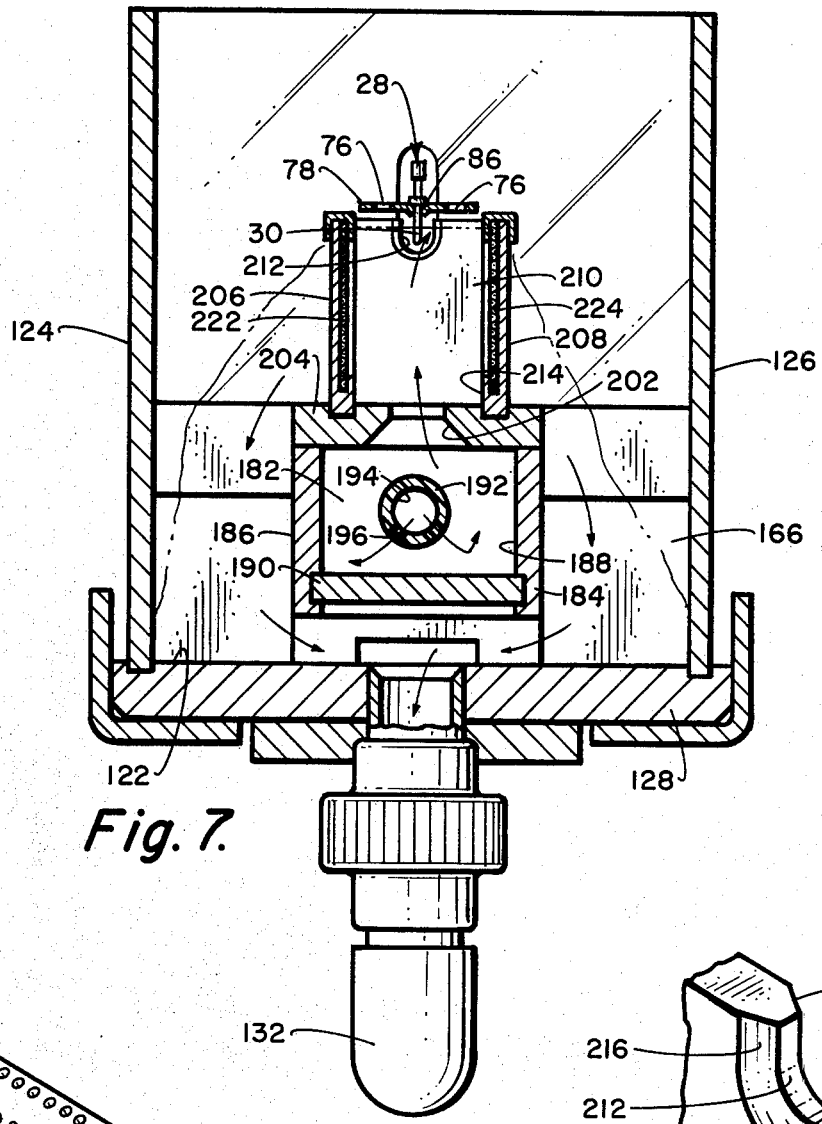
Fig. 7.
Fig. 7A.
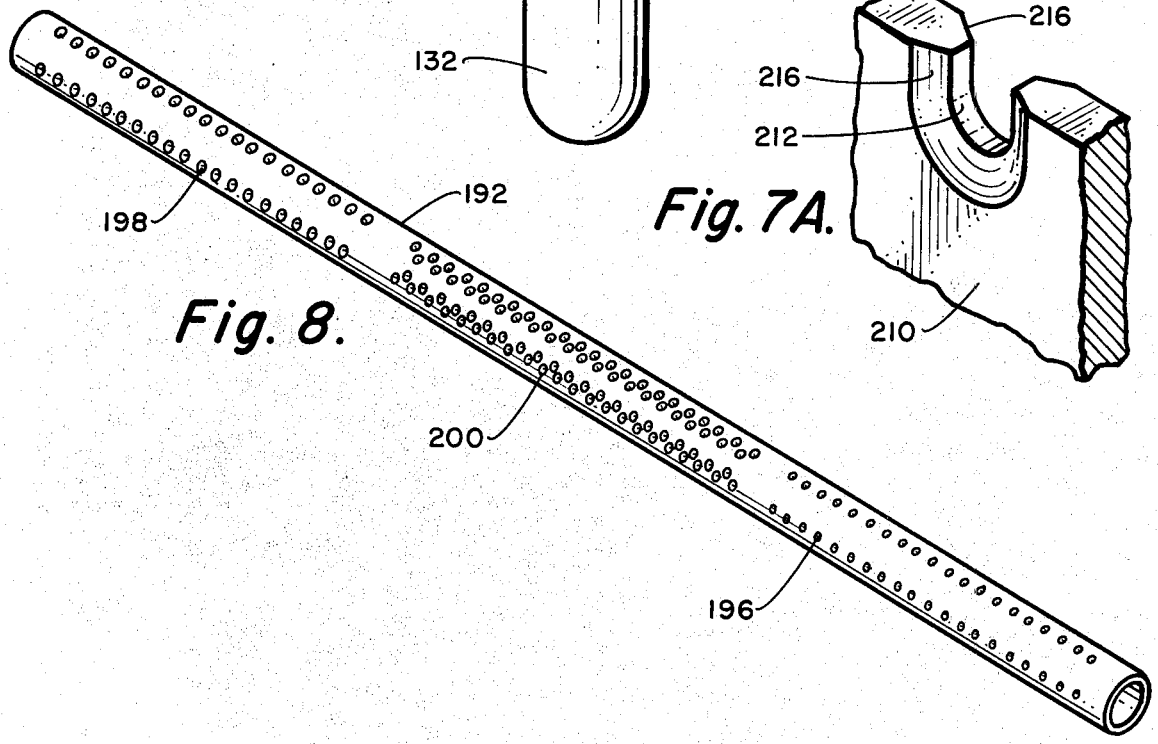
Fig. 8.

LOOSE PARTS PLATING APPARATUS

BACKGROUND OF THE INVENTION

The field of this invention relates to the electrodepositing of one metal onto another metal, and more particularly to an apparatus to facilitate the metallic plating of a portion of a small electrical connector, thereby eliminating the need to plate the entire connector.

It is well known that electrical connectors come in all sizes. At the present time, a substantial number of electrical connectors range from a half an inch in length to two inches in length. These electrical connectors are usually constructed of cuprous or possibly a ferrous metal. In order to facilitate electrical conductivity of the connectors, these connectors are usually plated with silver and/or gold, and/or palladium. Not only do these metals have the property of excellent conducting of electricity, these metals also have excellent corrosion resistant properties and are highly resistant to the action of most chemicals. The metal which is most commonly selected from gold, silver and palladium for electrical conductors is gold. The reason for this is that gold has the best overall properties for electrical connectors. This means that electrical conductors, when plated with these metals obtain an extremely lengthy operating life.

It is well known that the cost of gold, silver and palladium is quite high. In the past, a manufacturer of electrical connectors had found it to be economically feasible to only plate the entire part. It is known that it is only necessary to actually plate in the area of the electrical connection, which may only comprise a small portion of a part. But because of the small size of the part, it is only feasible to plate the entire part. Therefore, three to four times of the plating metal is being utilized than what is necessary.

This amounts to a significant expense for a company which manufacturers hundreds of thousands of electrical connectors each year. If there was a way to make it economically feasible to plate only the portion of the small electrical connector that functions to make the electrical connection, then a substantial decrease in plating expense could be obtained without any reduction in quality of the electrical connector.

SUMMARY OF THE INVENTION

The structure of the present invention takes the form of a plating bath wherein the level of the plating solution is contained within a plating chamber and the level of the plating solution is to be precisely controlled. A continuous belt is to be moved over the plating chamber. The continuous belt has a series of part locating holes formed therein. Within each part locating hole is to be located a loose part to be plated. The portion of the loose part that is to be plated extends beneath the continuous belt. As the continuous belt moves across the plating chamber, the portion of the loose part that is to be plated is passed through the plating solution. The position of the continuous belt in respect to the plating chamber can be adjusted. An installing station for automatically installing the loose parts onto the belt may be employed. Also, a discharge station for removing the parts from the belt after the plating operation may also be employed.

The primary objective of this invention is to provide an apparatus which permits the plating of only a small portion of an electrical connector to thereby eliminate the expense in the unnecessary plating of the entire electrical connector.

Another objective of this invention is to provide for the constructing of electrical connectors with the same high degree of electrical conducting properties while utilizing a substantially less amount of expensive plating metals, thereby making available an increased amount of such plating metals.

BRIEF DESCRIPTION OF THE DRAWINGS

FIG. 7 is a cross-sectional view taken along line 7—7 of FIG. 6;

FIG. 7*a* is an isometric view of a flow control gate which is employed in conjunction with the plating apparatus of this invention;

FIG. 8 is an isometric view of the tube that is employed within the plating bath of this invention to effect smooth, even dispersion of plating solution in a non-turbulent manner;

DETAILED DESCRIPTION OF THE SHOWN EMBODIMENT

Figure 1:
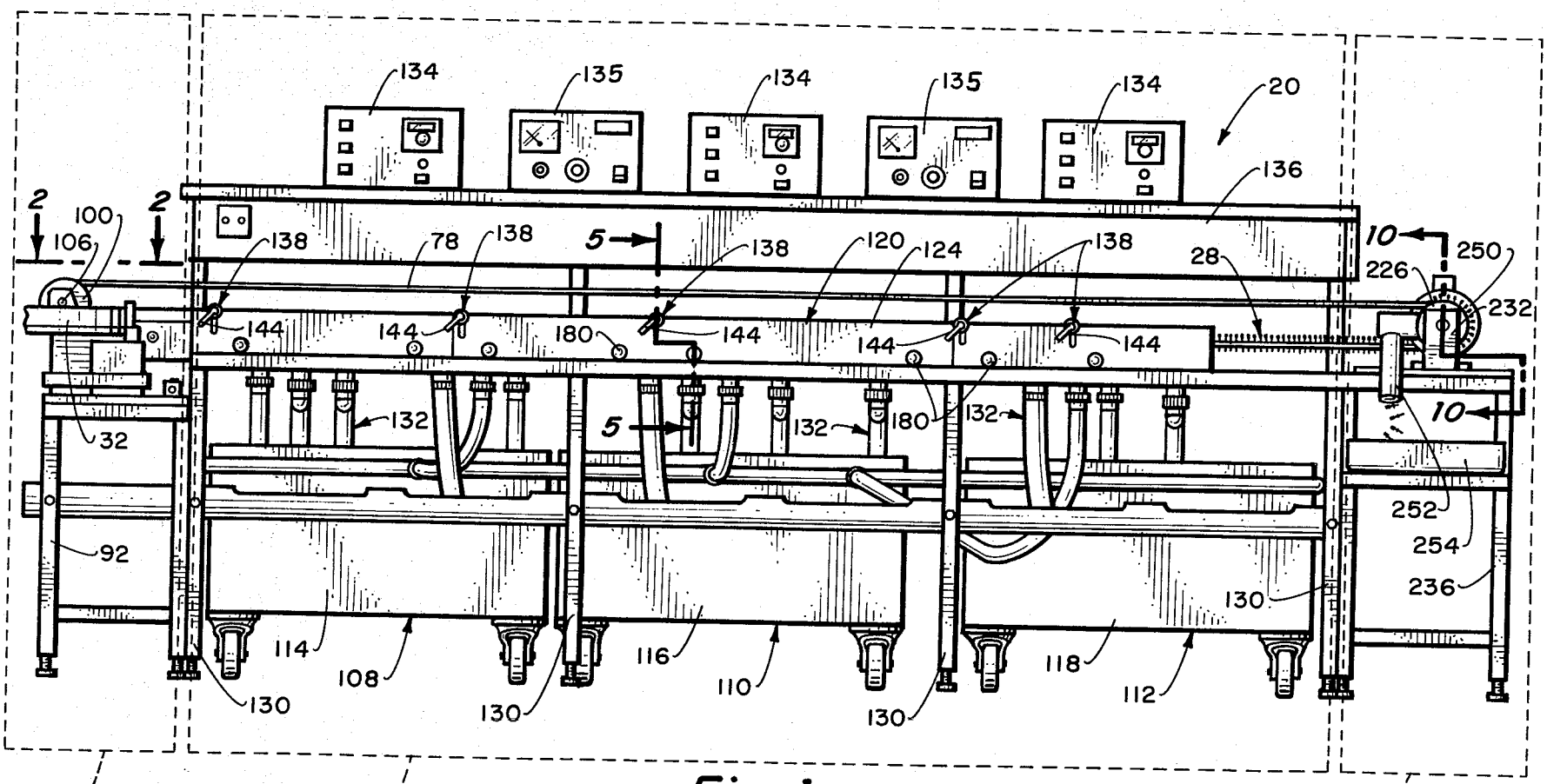
FIG. 1 is a front, elevational view of the loose parts plating apparatus of this invention.

Referring particularly to FIG. 1 of the drawings, there is shown the plating apparatus 20 of this invention which is composed generally of an installing station 22, a plating station 24 and a discharge station 26. It is to be understood that the principal inventive structure has to do with the plating station 24. The shown installing station 22 is for the purpose of automatically orientating the parts to be plated so as to then be conducted through the plating section 24. The installing station 22 could comprise one or more human beings achieving manual orientation of the parts. Also, the discharge station 26 could be eliminated with manual labor also being employed.

The plating apparatus 20 of this invention is designed to plate loose parts, such as part 28 shown. The part 28 is merely representative of a typical type of small electrical connector. The part 28 is, in physical size, approximately three centimeters in length. The part 28 has an electrical connecting end 30 which is to be inserted within an appropriate female socket (not shown) for the purpose of making a desired electrical connection. It is the end 30 that it necessary to be plated with the entire surface of the electrical connector 28 not required to be plated. The plating apparatus 20 of this invention is for the purpose of selectively plating just the end 30 with the main body portion of the connector 28 not being plated. An example of a typical plating thickness would be approximately fifteen hundreths of a micrometer. By only plating the portion of the connector 28 that is necessary, a substantial savings in expense, as well as savings in plating metal, will result by not having to plate the entire connector 28.

Figure 2:
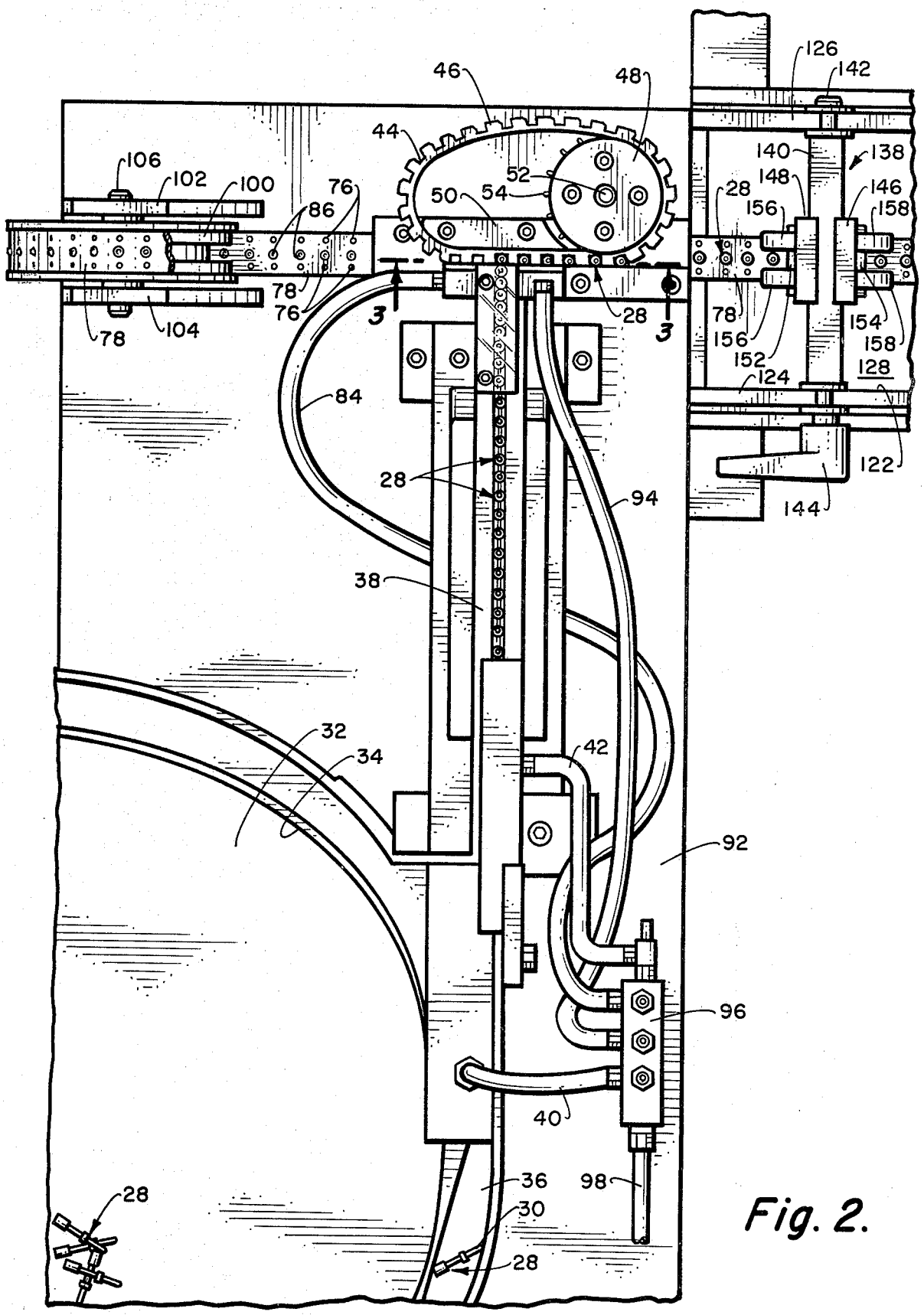
FIG. 2 is a top, plan view of the installing station incorporated in the loose parts plating apparatus of this invention taken along line 2—2 of FIG. 1.

The installing station 22 includes a tray 24 within which is to be deposited a quantity of the parts 28. Normally, several thousand of the parts 28 will be dumped within the tray 32. The tray 32 is rotated by an electric motor (not shown) and as the tray 32 is rotated, the parts 28 are moved against the peripheral edge 34 of the tray 32 and have a tendency to slide up a ramp 36. Due to the way the ramp 36 is constructed, the parts 28 will tend to be oriented so that the smaller end (end 30) proceeds forward up the ramp 36, with the larger end of the connector 28 being located in a rearward direction. This arrangement is generally depicted within FIG. 2 of the drawings.

The parts 28 are caused to move from the ramp 36 onto a guide track 38. In order to facilitate the location of the parts 28 onto the guide track 38, appropriate jets of air from conduits 40 and 42 will normally be utilized. The jets of air from the conduits 40 and 42 will be directed in such a manner as to correctly orient any askew part 28 into its proper location within the guide track 38.

The parts 28 are moved to the discharge end of the guide track 38. At the discharge end, a signal part 28 is to connect with a single recess 44 within a loading belt 46. There will be a continuous force tending to discharge a part 28 from the guide track 38. However, the only place that a part 28 can be discharged is within a recess 44. The loading belt 46 is rotatably driven by means of a drive pulley 48. A guide plate 50 is mounted within the interior of the loading belt 46 which insures that the loading belt 46 is continuously moved across the discharge end of the guide track 38. It is to be noted that slippage of the loading belt 46 with respect to the drive pulley 48 is prevented due to protuberances 54 mounted on the periphery of the drive pulley 48 which are to engage with appropriate openings 56 mounted within the loading belt 46.

The drive pulley 48 is fixedly mounted on a drive shaft 52. The drive shaft 52 is connected to a first bevel gear (not shown) which in turn is operably engaged with a second bevel gear 58. The second bevel gear 58 is fixedly mounted on a shaft 60. The shaft 60 is fixedly secured onto an idler pulley assembly 62. The idler pulley assembly 62 is rotatably mounted between plates 64 and 66. The shaft 60 is rotatably mounted by appropriate bearing assemblies with respect to the plates 64 and 66.

The idler pulley assembly 62 is composed of two identical parts 68 and 70, which are mounted together in a back-to-back relationship. When the parts 68 and 70 are so mounted, there is centrally disposed within the periphery of idler puller assembly 62, an annular groove 72. On either side of the groove 72 and protruding outwardly from the periphery of the idler pulley assembly 62 are a plurality of pins 74. Pins 74, on one side of the annular groove 72, are located within a given plane, while the pins 74 on the other side of the groove 72 are located in another plane. The pins 74 within each plane are evenly shaped apart a predetermined distance. This distance is equal to the spacing between indexing openings 76 formed within the continuous belt 78. This means that the continuous belt 78 is not able to slip with respect to the idler pulley assembly 62. It is to be noted that the protrusion of the pins 74 exteriorly of the periphery of the idler pulley assembly 62 can be adjusted by means of fasteners 80.

As a result of the foregoing, it can be seen that the movement of the continuous belt is tied directly to the movement of the loading belt 46. In other words, each time the belt 78 moves from the distance between adjacent indexing openings 76, the loading belt 46 is moved precisely the distance between adjacent recesses 44. The reason for this will now become apparent from the following description.

Figure 3:
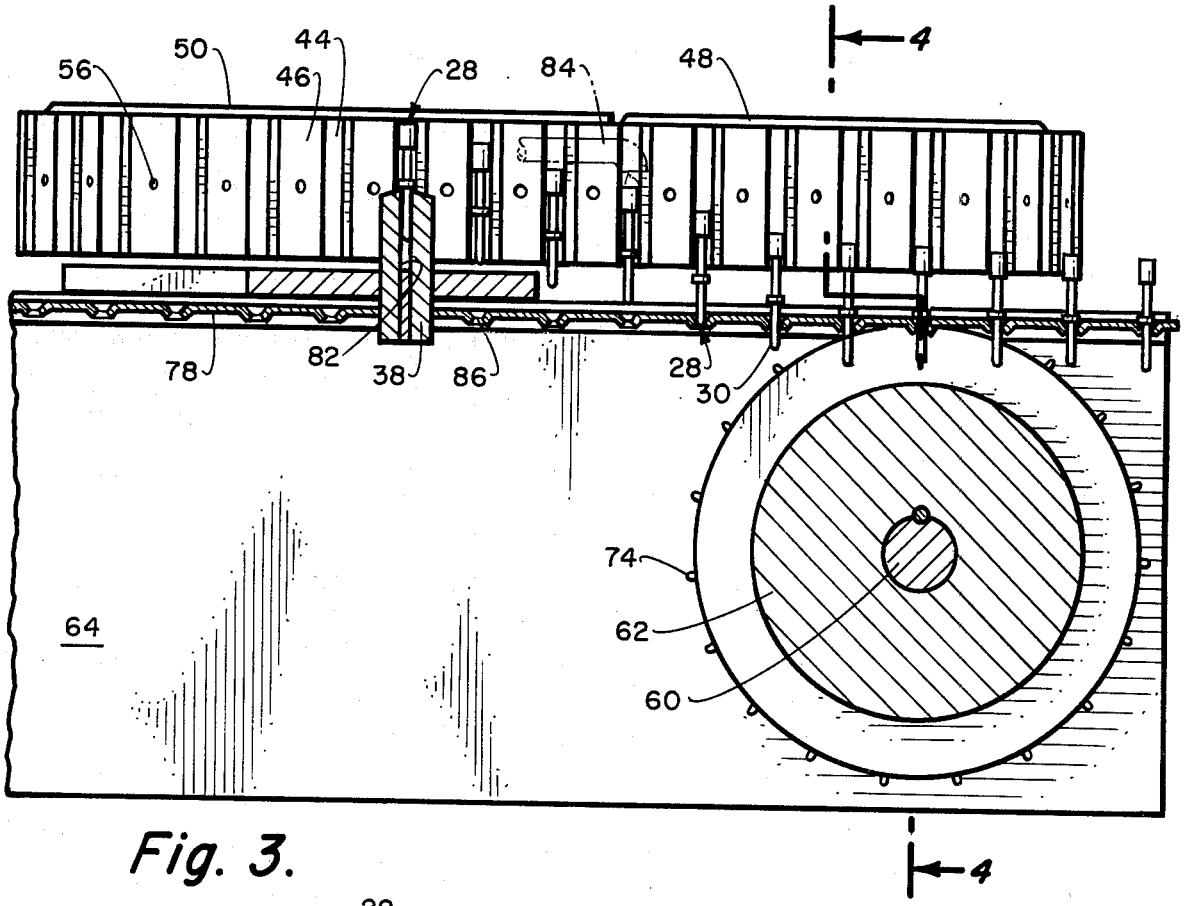
FIG. 3 is a cross-sectional view taken along line 3—3 of FIG. 2.
Figure 4:
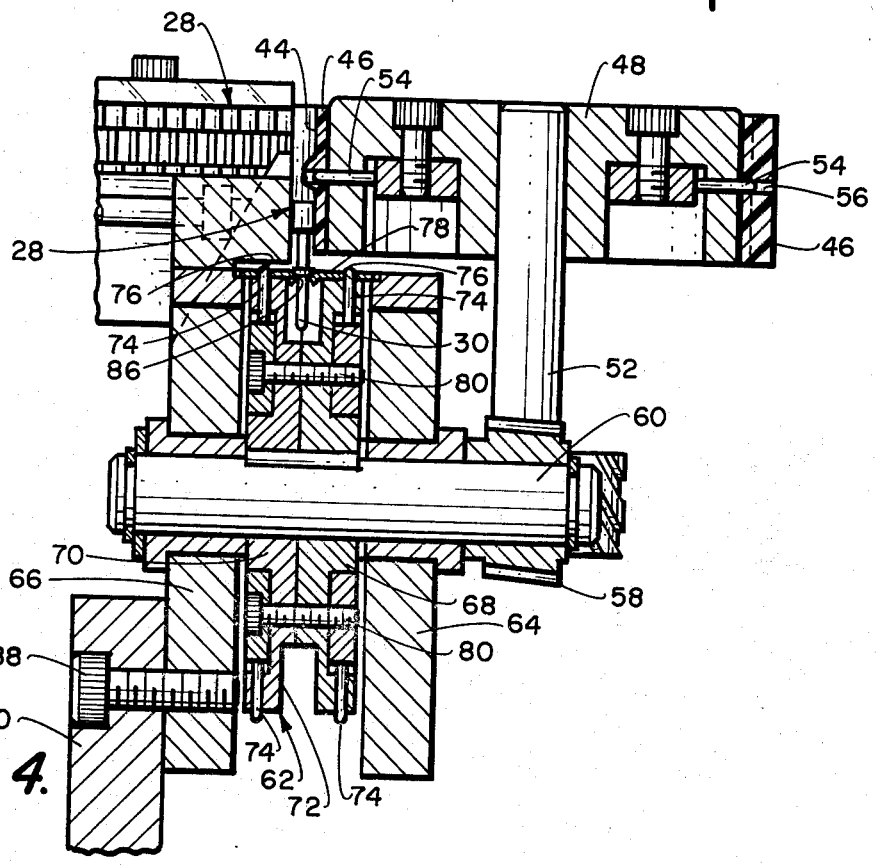
FIG. 4 is a cross-sectional view taken along line 4—4 of FIG. 3.
Figure 5:
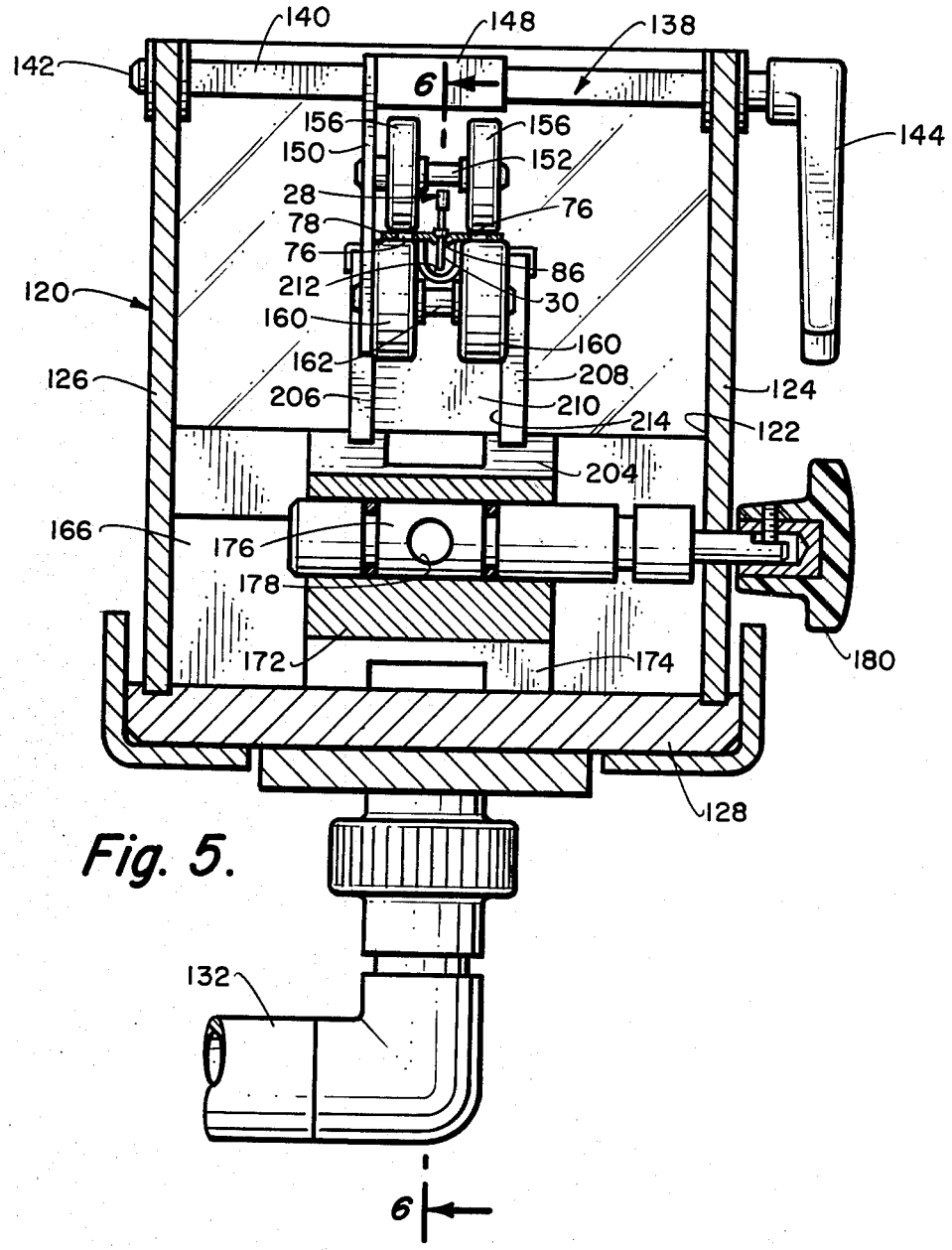
FIG. 5 is a cross-sectional view through one of the plating baths within the plating apparatus of this invention taken along line 5—5 of FIG. 1.
Figure 9:
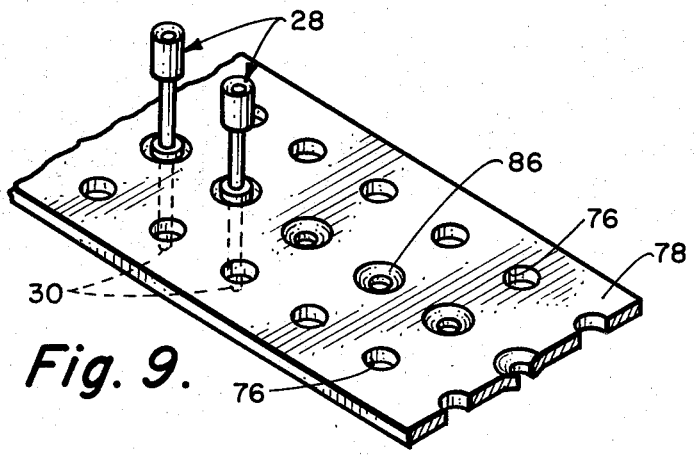
FIG. 9 is a segmental, isometric view of a portion of the continuous belt employed within the plating apparatus of this invention which is utilized to support the loose part to be plated.

Referring particularly to FIG. 3 of the drawings, as a part 28 is discharged from the elongated groove 82 formed within the guide track 38 and into a recess 44, and as the belt 46 continues to move, the part 28 then tends to fall by gravity toward the continuous belt 78. In order to assist in this falling movement, a jet of air from conduit 84 is to be injected within each recess 44 as the recess 44 passes by the conduit 84. Because the movement of the belt 78 is directly tied with the movement of the loading belt 46, each recess 44 is aligned directly with a single part locating hole 86. A part locating hole 86 is located between each pair of transversely aligned indexing holes 76. The movement of the belt 78 through the idler pulley assembly 62 and the shaft 60 is directly tied in unison with the movement of the loading belt 46 through the shaft 52 and the drive pulley 48. Therefore, a recess 44 will always be directly in line with a part locating hole 86 so that a part 28 will drop into a position within each hole 86.

It is to be noted that the plate 66 is fixedly secured by a conventional fastener 88 to a mounting plate 90. The mounting plate 90 is fixedly mounted onto a table 92. The table 92 is used to support the entire structure of the installing station 22. It is also to be noted that there will be employed various air jets in order to insure that each part 28 is properly and fully positioned within its locating hole 86. An additional air jet from a conduit 94 is shown within FIG. 2 in order to insure proper location of the parts 28. However, it considered to be within the scope of this invention that fewer air jets could be employed or a larger number of air jets. It is further to be noted that the air jet conduits 40, 42, 84 and 94 are connected through a valve assembly 96. The valve assembly 96 is in turn connected to a supply conduit 98 which in turn is connected to a source of pressurized air (not shown).

The continuous belt 78 will normally be constructed of metal so as to minimize stretching of the belt. One end of the belt 78 is mounted around idler pulley 100. Idler pulley 100 is rotatably mounted upon a shaft 106 between a pair of bracket members 102 and 104. The bracket members 102 and 104 are fixedly mounted on top of table 92.

After the belt 78 moves exteriorly of the installing station 22, the belt 78 begins to enter the plating station 24. At this particular time, there should be a part 28 fully positioned within each part locating opening 86. The electrical connecting end 30 of each part 28 protrudes a spaced distance (i.e., one to two centimeters) beneath the undersurface of the continuous belt 78.

In reference to FIG. 1, within the plating station 24 there is shown three separate plating sections 108, 110 and 112. Each plating section 108, 110, and 112 are basically duplicates of each other and each are separate from the other. Each plating section 108, 110 and 112 has, respectively, a wheeled storage container 114, 116 and 118. Storage containers 114, 116 and 118 are basically identical and each are to contain a quantity of a liquid solution.

Extending entirely across and above the containers 114, 116 and 118 is a main trough 120. The main trough 120 is composed of an elongated interior chamber 122 which is formed by spaced apart elongated sidewall members 124 and 126 which are mounted within bottom wall 128. The sidewalls 124 and 126 are interlocked in a tight fitting manner within appropriate grooves formed within the bottom wall 128. The main trough 120 is mounted on spaced apart leg assemblies 130 which in turn locates the main trough 120 in a desired location above the floor upon which it is mounted. The reason for the leg assemblies is also to locate the main trough 124 in a position above the storage containers 114, 116 and 118 so that the storage containers can be readily moved into and out of position underneath the main trough 124.

Extending from each of the storage containers 114, 116 and 118 are appropriate conduits 132. The conduits 132 are to be employed to move liquid between the storage containers 114, 116 or 118 and their respective plating sections 108, 110 or 112. It is to be noted that there will be employed appropriate pumps (not shown) to move the liquid. Operation of the pumps will be provided through control boxes 134. There are three in number of control boxes 134 shown, but any desired number of boxes 134 could be employed. It is to be understood the boxes 134 will also normally include indicating devices, such as a temperature indicator/controller and a liquid level sensor. The control boxes 134 are mounted onto an overhead table assembly 136. Also, there are shown two (in number) of DC rectifiers 135 to provide the electrical current for the cleaning and/or plating solutions.

The position, (height) of the continuous belt 78 from the inner surface of the bottom wall 128 can be adjusted within a limited range. The reason for this adjustment will become apparent further on in the description. The structure to effect this adjustment is accomplished through a guide roller assembly 138. It is to be understood that there will be a plurality of such guide roller assemblies employed in a spaced apart manner along the longitudinal length of the continuous belt 78. Within the structure shown within FIG. 1 there are actually five in number of guide roller assemblies 138. However, it is considered to be within the scope of this invention that a greater number or a fewer number of guide roller assemblies could be employed.

Each guide roller assembly 138 comprises an upper bar 140 which is located between sidewall members 124 and 126. A threaded rod 142 extends through an elongated opening formed within the bar 140. The rod 142 is rotatable with respect to the bar 140. The outer end of the threaded rod 142 extends through an elongated slot formed within the sidewall member 126. A similar slot is formed within the sidewall member 124 and the inner end of the threaded rod 142 extends therethrough. The inner end of the threaded rod 142 is threadably connected to a nut which is in turn integrally formed as part of handle 144. It is to be noted that the length of the bar 140 is selected to just be slightly smaller than the space between sidewall members 124 and 126. Thereupon, by exerting a slight tightening force of the handle 144, the sidewalls 124 and 126 are slightly moved toward each other and binding the bar 140 therebetween. The position of the bar 140 is then fixed. It is to be understood that the bar can be moved to any desired position (within the length of the slots defined within the sidewalls 124 and 126) and can be thereupon fixed in that position by again tightening down of the handle 144.

Supported upon each bar 140 are a pair of channel members 146 and 148. Channel members 146 and 148 are in a facing relationship with respect to the bar 140 and are capable of sliding movement in respect thereto. An appropriate set screw arrangement (not shown) is connected with either channel 146 or 148 in order to fixedly position these channel members at a desired longitudinal location along the bar 140.

The channel members 146 and 148 are integrally secured to a flange 150. Fixedly secured and extending outward from the flange 150 are a pair of pivot pins 152 and 154. It is to be noted that a plane passing through the longitudinal center axis of each of the pins 152 and 154 will be parallel to the planar upper surface of the continuous belt 78.

Rotatably mounted on the pivot pin 152 are a pair of spaced apart rollers 156 with a similar pair of spaced apart rollers 158 being rotatably mounted on the pivot pin 154. It is to be noted that the rollers 156 and 158 that are nearest the flange 150 are to be in contact with the continuous belt 78 and located on one side of the locating holes 86. The remaining rollers 156 and 158 ride against the upper surface of the belt 78 on the other side of the locating holes 86.

A pair of lower rollers 160 are rotatably mounted on a pivot pin 162 which is fixedly mounted and extends from the flange 150. The roller 160 nearest the flange 150 rests against the lower side of the continuous belt 78 to one side of the locating holes 86, while the other roller 160 is located against the belt 78 to the other side of the locating holes 86. It is to be noted that the spacing between the rollers 160 and the rollers 156 and 158 is such that the continuous belt 78 is just conducted therebetween in a tight-fitting manner. Another feature of this guide roller assembly is that it is electrically grounded to provide an electrical ground through the continuous belt 78 to the part 28. The part 28 is the cathode.

It can therefore be seen by the foregoing that by loosening of the handle 144, the height of the continuous belt 78 within the interior reservoir 122 can be changed. The reason for this is that changing of the height will normally be necessary when plating is to be accomplished on different length parts 28.

For purposes of description, each plating station 108, 110, and 112 are identical and only a single description of the plating station will be discussed. This description will be confined to plating station 110. It is to be understood that this description will also apply to plating stations 108 and 112.

The station 108 could be utilized in the form of an acid bath in order to wash the part to be plated to make the surface of the part more readily susceptible to adhere to the plating metal. The plating section 110, for example, could include a nickel plating solution with the plating section 112 to include a gold plating solution. However, it is considered to be within the scope of this invention that any of the stations 108, 110 and 112 could be utilized to accommodate any particular desired solution.

The conduits 132 of plating station 110 are conducted through the bottom wall 128 and connect with the interior reservoir 122. The interior reservoir 122 is separated from the other portion of the interior reservoir 122 by means of spaced apart barriers 164 and 166. The plating solution 168 is to be capable of flowing within the portion of the interior chamber 122 confined between the barriers 164 and 166 to be conducted within the appropriate conduits 132 and hence to the storage container 116. It is to be noted that there are two in number of the outlet conduits 132 which are conducted to the storage container 116. However, there may be only a single outlet conduit or there may be more than two.

The plating solution from the container 116 is conducted through one of the conduits 132, through the bottom wall 128 to within passage 170 formed within block 172. The block 172 is mounted on a base 174 which in turn is supported on the inner surface of the bottom wall 128.

The flow through the passage 170 is capable of being diminished and increased by the use of spool 176. Spool 176 has a passage 178 which, when aligned with the passage 170, permits complete flow through the block 174. Turning of the spool 176 by means of handle 180, which protrudes exteriorly of the sidewall 124, regulates the volume of flow being conducted through the block 174. It will become apparent further on in the specification that the regulating of the volume of flow thereby varies the level of the plating solution.

Spaced from the block 172 and mounted on the bottom wall 128 is an end wall 182. Connecting the end wall 182 and the block 172 on the sides thereof are sidewalls 184 and 186. The sidewalls 184 and 186 function in connection with the block 172 and end wall 182 to form an enclosed lower reservoir 188. Closing the bottom of the lower reservoir 188 is a bottom plate 190. The upper end of the lower chamber 188 is open.

Integrally secured between the block 172 and the end wall 182 is a tube 192. The tube 192 has an interior passage 194. The passage 194 connects with the passage 170 and is adapted to receive the plating solution therefrom.

Formed through the sidewall of the tube 192 are a plurality of openings. These openings are divided into an outer section, middle section and an inner section. The outer section of openings is located directly adjacent the end wall 182. The inner section of openings is located directly adjacent the block 172. It is to be noted that the length of each group of openings with respect to the longitudinal length of the tube 192 is approximately the same.

The openings 196 within the outer section are divided into two separate rows and are noticed to be of smaller diameter than the two rows of openings 198 formed within the inner section. Within the middle section, the openings 200 are shown to be substantially greater in number and of a diameter in between the diameter of openings 198 and 196. The reason for the different sizes of openings within the tube 192 are so that plating solution flowing from passage 194 within the tube 192 is substantially evenly distributed across the longitudinal length of the lower chamber 188. It has been found that if just a single series of openings were located across the tube 192, that the greatest liquid flow would occur at the outer end of the tube 192 with the next greatest flow occuring at the inner end of the tube 192. Within the middle section of the tube, there would be substantially diminished flow. Therefore, to overcome this uneven flow distribution, the minimum opening area is located within the outer end of the tube, with a somewhat increased size of opening area being at the inner end of the tube. Within the middle section of the tube, the area of the openings is still further increased, although the individual opening size is smaller (but greater in number of openings 200 are provided). This particular opening arrangement has been found to be satisfactory and was obtained merely by experimentation. It is considered to be within the scope of this invention that other opening arrangements could be employed to achieve this same end result.

As the liquid flows upwardly out of the outlet opening 202 within the upper wall 204, it is desired that the level of the solution be as smooth as possible and nontubulent. In order to assist in achieving this end result, the tube 192 is oriented so that the openings 196, 198 and 200 are all directed downward toward bottom plate 190. This gives the chance for any created turbulence to diminish prior to flow of the solution through the outlet opening 202.

Mounted within appropriate grooves formed within upper wall 204 are a parallel pair of spaced-apart side plates 206 and 208. Adjacent the ends of each of the side plates 206 and 208 is located a groove. The grooves within each of the ends are to facilitate connection with a flow control gate 210. Each of the gates 210 are deemed to be identical and are to be slid in and out of the appropriate grooves within the side plates 206 and 208.

Figure 6:
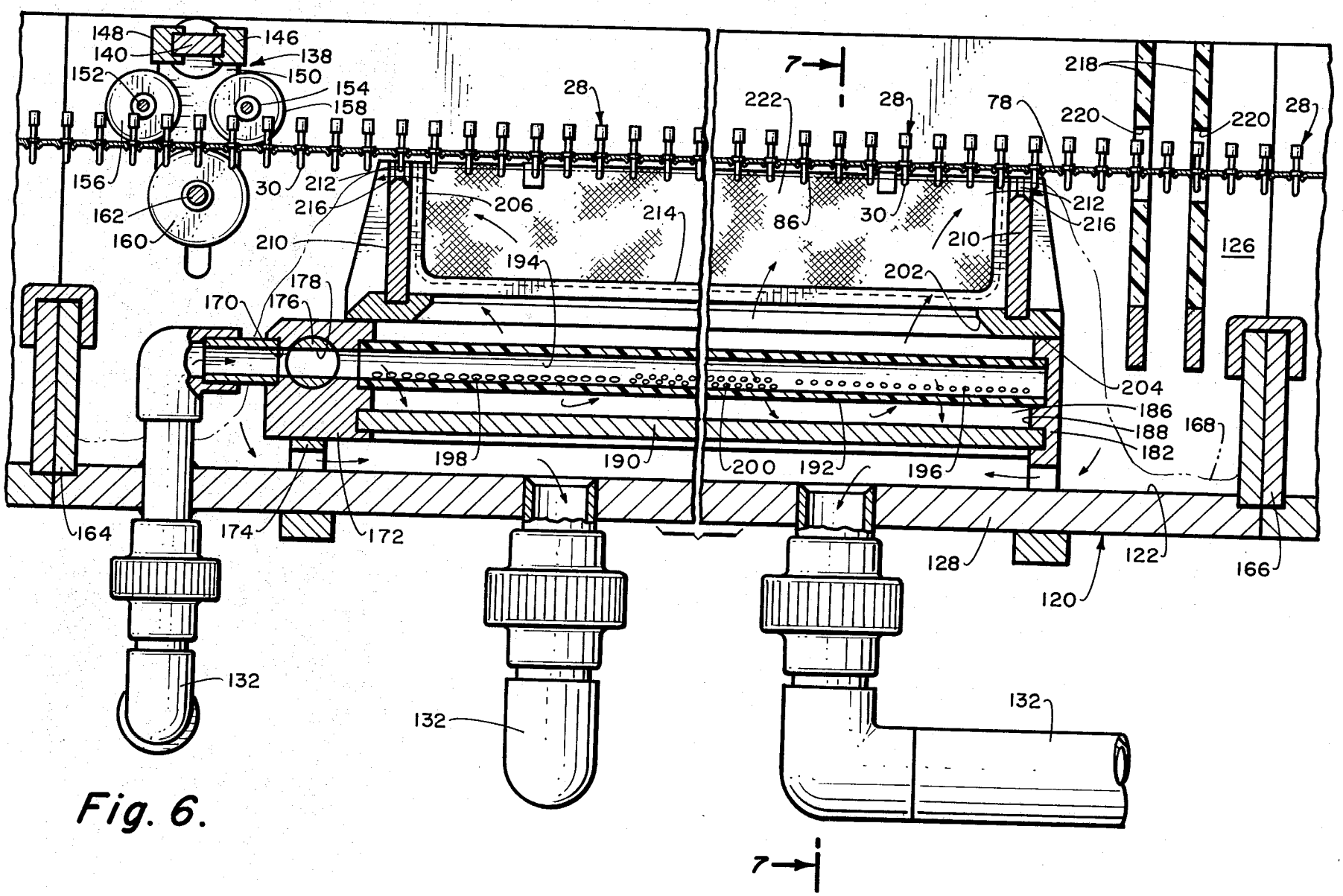
FIG. 6 is a longitudinal, cross-sectional view through one of the plating baths within the plating apparatus of this invention taken along line 6—6 of FIG. 5.
Figure 10:
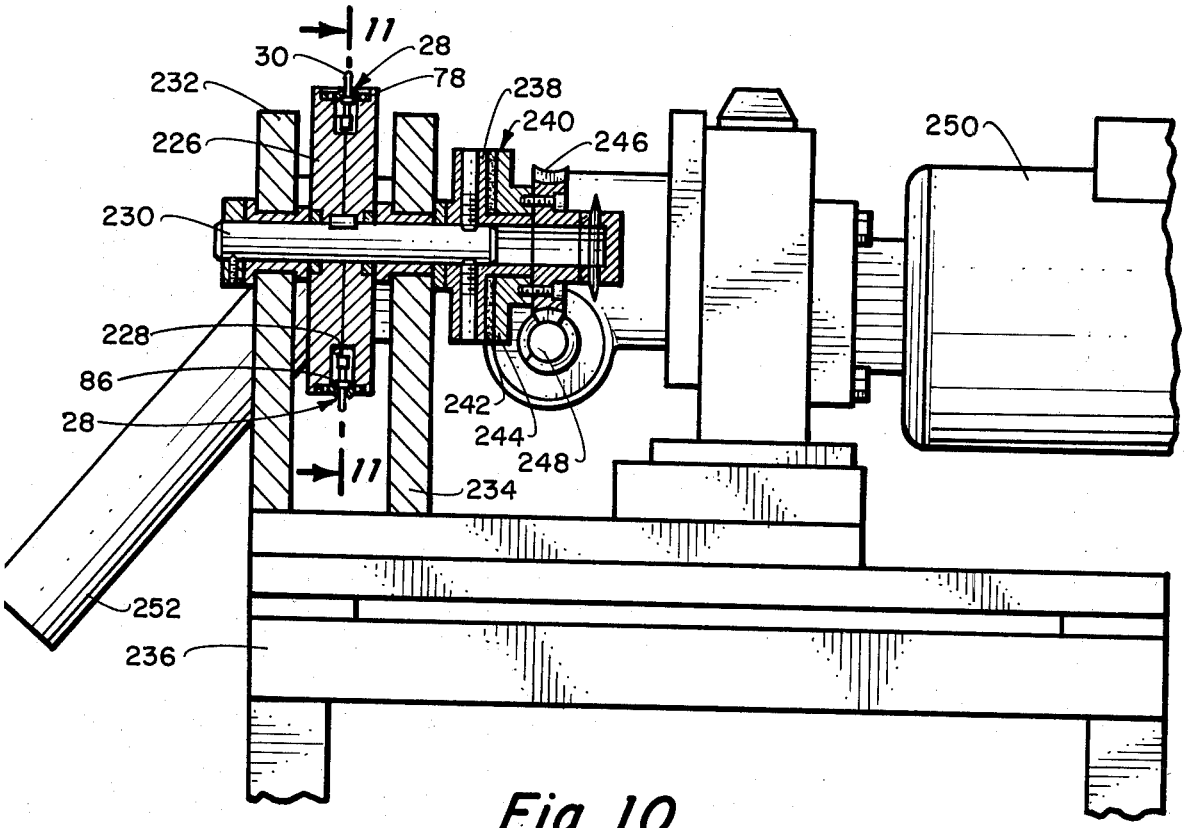
FIG. 10 is a partly-in-cross-sectional view through a portion of the discharge station of the plating apparatus of this invention taken along line 10—10 of FIG. 1.
Figure 11:
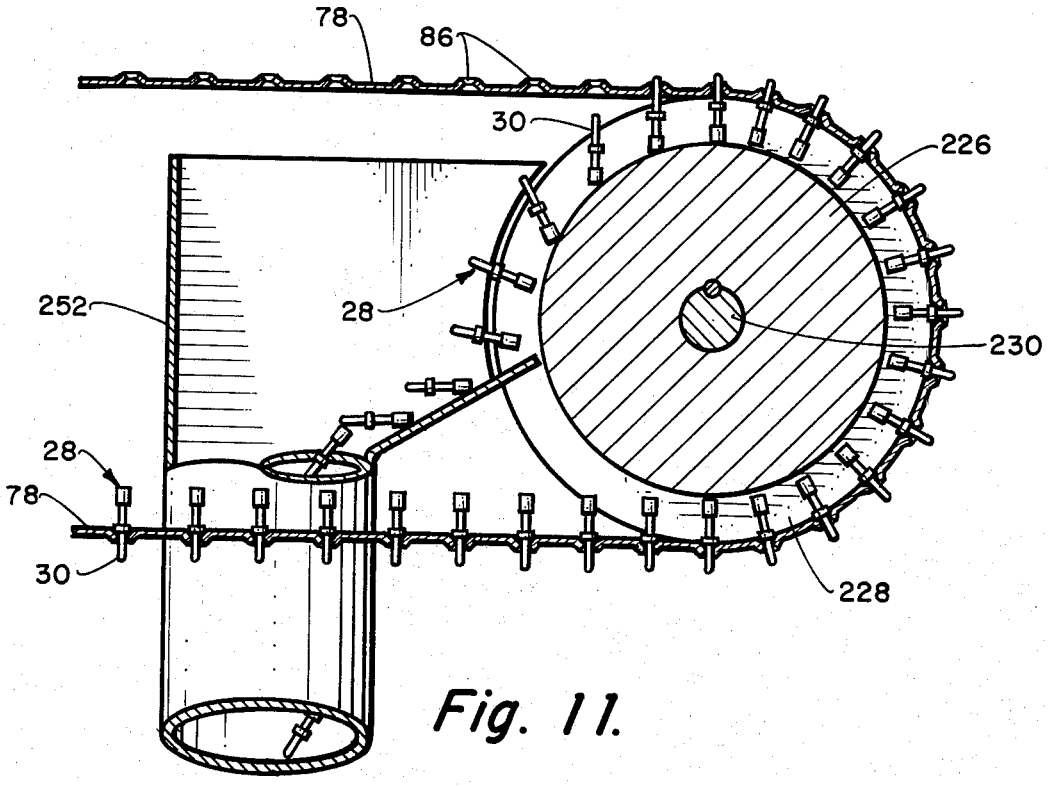
FIG. 11 is a cross-sectional view taken along line 11—11 of FIG. 10.

Formed within each gate 210 is an enlarged slot 212. The slot 212 is open at the upper edge of the flow control gate 210. The depth of the slot 212 may be varied depending upon the length of the portion of the part 28 that extends below the belt 78. In other words, if the portion of the part 28 that extends below the belt 78 is relatively short (such as one to two centimeters), then the depth of the enlarged slot 212 needs to be only somewhat larger than that. However, if the length of the portion of the part 28 that extends below the belt 78 is substantially longer, such as five centimeters or longer, then the depth of the enlarged slot 212 would have to be somewhat greater than that. The reason for this is that, as can be readily seen from FIG. 6, the portion of the parts 28 that protrude below the belt 78 is to be conducted through the enlarged slot 212 and come into contact with the level of solution within the upper chamber 214 which is formed by the enclosed area defined by the flow control gates 210 and the side plates 206 and 208. By regulating the volume of flow by turning of spool 176, the surface level of the plating solution within the upper chamber 214 can be raised or lowered quite precisely. The flow control gates 210 function as a weir and the plating solution is merely conducted through the enlarged slots 212 to pour into the enlarged collecting chamber 122. It has been found that in actual practice, by rotating of the spool 176, the surface level of the solution within the chamber 214 can be controlled quite accurately to within a few hundreths of a centimeter. This is particularly desirable since again the plating apparatus of this invention is to be utilized for plating only a small portion of a very small part.

In order to minimize turbulence of the solution within the chamber 214, the flow control gate 210 is constructed so that the enlarged slot 212 has a beveled edge 216 on each side of the enlarged slot 212. This is for the reason that the solution flows smoothly across the surface of the enlarged slot and there is not a right angled surface which would cause undesirable turbulence.

It is undesirable to have any of the plating solution be splashed or otherwise thrown out of its particular section of the interior chamber 122. For this reason, it may be desirable to mount splash guards 218 between the flow control gate 210 and its adjacent barrier 164 or 166. The splash guards 218 are to contain a central opening 220 to permit passage therethrough of the continuous belt 78 and the parts 28 mounted therein. It is to be understood that there may be only one splash guard 218 employed or no splash guard. Also, it may be within the scope of this invention that two or more splash guards in a closely arranged manner could be employed, such as shown within FIG. 6 of the drawings. Splash guards 218 will be mounted on the sidewall members 124 and 126. It may also be considered to be within the scope of this invention to locate an air jet between the closely spaced splash guards 218, as shown within FIG. 6. This air jet is to facilitate a drying of the part 28 as it is passed through the space between the splash guards 218 to prepare the part for the next operation.

Fixedly mounted on the inner surface of the side plate 206 is a metallic screen 222. A similar metallic screen 224 is mounted on the inner surface of the side plate 208. Electrically, both screen 222 and screen 224 function as anodes. With the guide roller assembly 138 providing the cathode connection an electroplating cell is thereby compled.

After the plated part has left the plating station 24, it is necessary to remove the parts 28 from the continuous belt 78. For this purpose, discharge station 26 is to be employed and is now to be described.

Within the discharge station 26 there is located a drive pulley 226. The drive pulley 226 includes an annular recess 228 formed within its periphery. Draped around the pulley 226 is the other end of the continuous belt 78. The purpose of the annular recess 228 is so as to provide space for the upper or the main portion of the electrical connector 28.

The drive pulley 226 is fixedly mounted on a drive shaft 230. The drive shaft 230 is rotatably mounted by appropriate bearing assemblies between a pair of plates 232 and 234. The plates 232 and 234 are fixedly mounted onto a table 236 which in turn is supported on the floor or other appropriate supporting surface.

The inner end of the drive shaft 230 is fixedly mounted to the first plate 238 of a slip clutch assembly 240. The first plate 238 connects with a clutch pad 242 which in turn is mounted on a second plate 244. The second plate 244 is in turn fixedly secured to a gear 246. The gear 246 is operatively connected to a drive gear 248. The drive gear is to be rotatably driven by a drive motor 250.

Rotation of the motor 250 rotates gear 248, which in turn rotates gear 246. The shaft 230 is then rotated through the slip clutch assembly 240. The purpose of the slip clutch assembly 240 is that in case there occurs any kind of undesirable blockage, the continuous belt 78 will stop while the motor 250 continues to operate so as not damage either motor 250 or to any of the continuous belt mechanism. The motor 250 functions as the only source of power for the moving of the continuous belt 78.

As the continuous belt 78 is turned upon pulley 226, the parts 28 then will move to an up-side-down position. As the belt 78 continues to move, the parts 28 will fall be gravity out of association with their respectively locating holes 86. An appropriate guide tube 252 is employed to direct the disconnected parts 28 toward a collection tray 254.

What is claimed is:

1. A loose parts plating apparatus comprising:

plating bath means for electrodepositing of a thin layer of metal onto a part to be plated;

movement means for locating in a series arrangement a plurality of said parts, said movement means to cause only a portion of said parts to be conducted through said plating bath;

an installing station for installing said parts on said movement means prior to being moved into said plating bath;

a discharge station for removing said parts from said movement means after moving of said parts out of said plating bath; and said plating bath means including a plating reservoir assembly and a separate storage reservoir for plating solution, conduit means connecting said plating reservoir assembly and said storage reservoir for the conducting of plating solution therebetween.

2. The loose parts plating apparatus as defined in claim 1 wherein:

said plating reservoir assembly comprising an interior reservoir assembly mounted within an enlarged exterior reservoir assembly, said interior reservoir assembly comprising a lower reservoir and an upper reservoir, a plating solution passage connected between said lower reservoir and said upper reservoir permitting only flow of plating solution from said lower reservoir to said upper reservoir.

3. The loose parts plating apparatus as defined in claim 2 including:

a flow distributing means mounted within said lower reservoir, said flow distributing means to evenly disperse the plating solution across said lower reservoir to minimize turbulence within said upper reservoir.

4. The loose parts plating apparatus as defined in claim 3 wherein:

said even flow distributing means comprising a tube having a plurality of spaced-apart openings through the sidewall thereof through which plating solution is to be conducted, said tube being oriented in such a manner as to direct the inflow of plating solution from said tube in a direction substantially away from said upper reservoir.

5. The loose parts plating apparatus as defined in claim 4 wherein:

said series of openings within said tube being of different sizes.

6. The loose parts plating apparatus defined in claim 5 wherein:

said tube being closed at its outermost end, said tube having an outer section located directly adjacent said outermost end, said tube having a middle section connecting with said outer section, said tube having an inner section connecting with said middle section, the total opening area within said inner section being greater than the total opening area within said outer section, the opening area within said middle section being greater than the opening area within said inner section.

7. The loose parts plating apparatus as defined in claim 2 wherein:

said upper reservoir having an entry end and an exit end for said loose parts, said entry end being closed by a first flow control gate and said exit being closed by a second flow control gate, both said first flow control gate and said second flow control gate being removably connected to said upper reservoir.

8. The loose parts plating apparatus as defined in claim 7 wherein:

both said first flow control gate and said second flow control gate including an elongated slot through which plating solution is to be discharged from said upper chamber into said enlarged exterior reservoir.

9. The loose parts plating apparatus as defined in claim 8 wherein:

the edges of said elongated slot being beveled so as to facilitate smooth even flow of the plating solution through said slot.

10. A loose parts plating apparatus comprising:

plating bath means for electrodepositing of a thin layer of metal onto a part to be plated;

movement means for locating in a series arrangement a plurality of said parts, said movement means to cause only a portion of said parts to be conducted through said plating bath;

an installing station for installing said parts on said movement means prior to being moved into said plating bath;

a discharge station for removing said parts from said movement means after moving of said parts out of said plating bath;

said installing station comprising a rotating tray assembly which functions to cause said loose parts to be located in an in-line relationship on a guide track, said guide track having a discharge end, said loose parts being deposited from said discharge end onto said movement means, and said installing station further including a loading belt, said loose parts being discharged from said discharge end of said guide track to be connected with said loading belt prior to contact with said movement means.

11. The loose parts plating apparatus as defined in claim 10 wherein:

said loading belt including a plurality of spaced-apart recesses, a said loose part from said discharge end of said guide track to connect with a said recess, said loading belt being continuous.

12. The loose parts plating apparatus as defined in claim 11 wherein:

said loading belt being synchronized in movement in respect to said movement means.

13. The loose parts plating apparatus as defined in claim 12 wherein:

said discharge station causing said continuous belt to be turned up-side-down to thereby cause said loose parts to be discharged by gravity from said continuous belt.

14. The loose parts plating apparatus comprising:

plating bath means for electrodepositing of a thin layer of metal onto a part to be plated;

movement means for locating in a series arrangement a plurality of said parts, said movement means to cause only a portion of said parts to be conducted through said plating bath;

an installing station for installing said parts on said movement means prior to being moved into said plating bath;

a discharge station for removing said parts from said movement means after moving of said parts out of said plating bath;

said movement means including a continuous belt, said continuous belt having a plurality of spaced-apart part locating holes, a single said loose part to be located within a single said part locating hole; and said discharge station causing said continuous belt to be turned up-side-down to thereby cause said loose parts to be discharged by gravity from said continuous belt.

15. A loose parts plating apparatus comprising:

plating bath means for electrodepositing of a thin layer of metal onto a part to be plated;

movement means for locating in a series arrangement a plurality of said parts, said movement means to cause only a portion of said parts to be conducted through said plating bath;

an installing station for installing said parts on said movement means prior to being moved into said plating bath;

a discharge station for removing said parts from said movement means after moving of said parts out of said plating bath;

said movement means comprising a continuous belt, said continuous belt including a plurality of spaced-apart part locating openings, a said loose part to be located within each said part locating opening, said portion of said parts to protrude beneath said continuous belt; and said plating bath means including a plating reservoir assembly and a separate storage reservoir for plating solution, conduit means connecting said plating reservoir assembly and said storage reservoir for the conducting of plating solution therebetween.

16. The loose parts plating apparatus as defined in claim 15 wherein:

said plating reservoir assembly comprising an interior reservoir assembly mounted within an enlarged exterior reservoir assembly, said interior reservoir assembly comprising a lower reservoir and an upper reservoir, a plating solution passage connected between said lower reservoir and said upper reservoir permitting only flow of plating solution from said lower reservoir to said upper reservoir.

17. The loose parts plating apparatus as defined in claim 16 wherein:

a flow distributing means mounted within said lower reservoir, said flow distributing means to evenly disperse the plating solution across said lower reservoir to minimize turbulence within said upper reservoir.

18. The loose parts plating apparatus as defined in claim 17 wherein:

said even flow distributing means comprising a tube having a plurality of spaced-apart openings to the sidewall thereof through which plating solution is to be conducted, said tube being oriented in such a manner as to direct the inflow of plating solution from said tube in a direction substantially away from said upper chamber.

19. The loose parts plating apparatus as defined in claim 18 wherein:

said series of openings within said tube being of different sizes.

20. The loose parts plating apparatus as defined in claim 19 wherein:

said tube being closed at its outermost end, said tube having an outer section located directly adjacent said outermost end, said tube having a middle section connecting with said outer section, said tube having an inner section connecting with said middle section, the total opening area within said inner section being greater than the total opening area within said outer section, the opening area within said middle section being greater than the opening area within said inner section.

21. The loose parts plating apparatus as defined in claim 20 wherein:

said upper reservoir having an entry end and an exit end for said loose parts, said entry end being closed by a first flow control gate and said exit end being closed by a second flow control gate, both said first flow control gate and said second flow control gate being removably connected to said upper chamber.

22. The loose parts plating apparatus as defined in claim 21 wherein:

both said first flow control gate and said second flow control gate including an elongated slot through which plating solution is to be discharged from said upper reservoir into said enlarged exterior reservoir.

23. The loose parts plating apparatus as defined in claim 15 wherein:

said belt including indexing holes, said indexing holes to connect with the drive means to facilitate moving of said belt at a known velocity.

24. The loose parts plating apparatus as defined in claim 23 wherein:

guide roller assembly being connected to said belt, said guide roller assembly being adjustable to be capable of varying the position of said belt in respect to said plating bath means.

* * * * *